United States Patent [19]

Held

[11] Patent Number: 4,658,726

[45] Date of Patent: Apr. 21, 1987

[54] FUZE FOR SETTING OFF JACKETED EXPLOSIVE CHARGES

[75] Inventor: Manfred Held, Aresing, Fed. Rep. of Germany

[73] Assignee: Messerschmitt-Bölkow-Blohm GmbH, Munich, Fed. Rep. of Germany

[21] Appl. No.: 706,017

[22] Filed: Feb. 27, 1985

[30] Foreign Application Priority Data

Feb. 29, 1984 [DE] Fed. Rep. of Germany ..... 3407397

[51] Int. Cl.[4] ..... F42C 3/00; F42C 15/10

[52] U.S. Cl. ..... 102/416; 102/202.1; 102/223; 102/306

[58] Field of Search ..... 102/221, 223, 202.1, 102/416, 390, 306

[56] References Cited

U.S. PATENT DOCUMENTS 3,169,481 2/1965 Stresau, Jr. et al. ..... 102/221
3,190,219 6/1965 Venghiattis ..... 102/306
3,351,011 11/1967 Montesi ..... 102/221
3,765,331 10/1973 Montesi ..... 102/416
3,765,332 10/1973 Baker et al. ..... 102/416
4,395,951 8/1983 Hinely et al. ..... 102/223

FOREIGN PATENT DOCUMENTS 2360226 6/1975 Fed. Rep. of Germany .

*Primary Examiner*—Charles T. Jordan

[57] ABSTRACT

A fuze for setting off jacketed explosive charges, particularly underwater charges, comprises a breaking wall aimed at the explosive charge, and an initiating charge aimed at the breaking wall. Between the initiating charge and the breaking wall, an intermediate space is provided which can be filled with water. With the intermediate space filled with water, upon detonating the initiating charge, a shockwave is produced in the water in the intermediate space by which the breaking wall is fragmented to form a piercing spike setting off the explosive charge.

5 Claims, 1 Drawing Figure

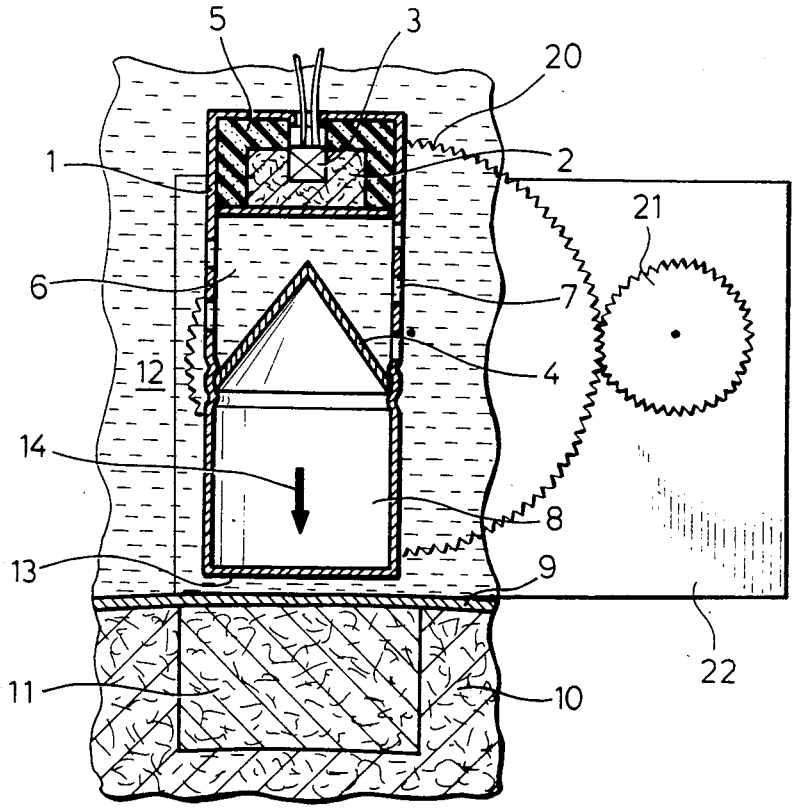
5
3
20
1
2
21
6
7
12
4
14
8
13
9
22
11
10

FUZE FOR SETTING OFF JACKETED EXPLOSIVE CHARGES

FIELD AND BACKGROUND OF THE INVENTION

This invention relates in general to ignition devices for explosive charges and in particular to a new and useful fuze for setting off jacketed explosive charges and to a method of regulating when the explosion takes place.

Military regulations concerning jacketed bursting charges require a separation of the main explosive charge from the priming charge. By priming charges such explosives are understood which are more sensitive than tetryl. This includes most of the detonators. Under these regulations, an explosive chain is permitted to close only after two unpriming conditions, independent of each other, are satisfied which cannot occur under other conditions of use. With spinning projectiles, such conditions may be the discharge acceleration and the rotation, for example.

With underwater explosive charges, such as sea mines or torpedo devices, considerable difficulties are met in attempts to find such criteria quite independent from each other. For example, it has been provided to employ a water soluble substance preventing the detonator from moving from safety to priming position as long as the substance has not dissolved in contact with water. The substance, however, was also sensitive to air humidity, so that an unintentional activation could not reliably be prevented. Further, the effect of such a mechanism cannot be reversed.

Frequently, however, it is desirable to render the underwater explosive charge safe again after it is removed from the water. A typical example are cable cutters used in mine sweeping. After hauling them in again, these cutting charges must be unprimed.

German Pat. No. 23 60 226 discloses a fuze for setting off jacketed explosive charges. That disclosure provides a mechanically driven device by which the hollow charge with its lining forming the breaking wall can be pivoted between an armed position in which the hollow firing charge is in alignment with the principal explosive charge, and a retracted position in which the intermediate safety space is formed between the two charges.

The mechanism needed for this purpose is relatively expensive. Further, priming is possible even with the charge out of water, and unpriming, after removing the charge from the water, again requires a pivoting of the hollow charge, i.e. an actuation of the pivoting mechanism.

From U.S. Pat. No. 3,190,219, there is known an arrangement with a device to be lowered into drill holes, comprising a blasting charge, a hollow charge lining, a liquid filled intermediate space between the blasting charge and the lining, and an empty further intermediate space provided in front of the lining in the effective direction of the charge. By the pressure wave produced upon the ignition of the blasting charge, a sharp fragment or spike is formed of the lining, piercing the drill pipe and penetrating into the adjacent ground. The liquid, such as water or hydrochloric acid, follows the spike and is intended to increase the depth of penetration and clean the passages underground.

SUMMARY OF THE INVENTION

The present invention is directed to a fuze permitting in a simple way, at least an independent unpriming.

The inventive fuze is particularly suitable for underwater charges, and for such a use, the intermediate space between the initiating charge and the breaking wall is designed to communicate with the ambience, i.e. air or water. In such instances, an extraordinarily reliable function of the fuze is ensured. That is, one of the arming conditions is that the charge may be immersed in water, since only then the intermediate space between the initiating charge and the breaking wall is filled with water and the explosive chain is closed. An automatic disarming is then effected by simply removing the charge from water, so that the water flows out of said intermediate space and is replaced by air. Even with the initiating charge being ignited due to an error a detonation of the main explosive charge would safely be prevented since the intermediate space between the initiating charge and the breaking wall, now filled with air, is not capable of propagating a shock wave leading to a collapse of the breaking wall.

Accordingly, it is an object of the invention to provide an improved safety fuze with an initiating charge which causes the detonation of a breaking wall to penetrate the main charge and set if off and which includes a space which may be left vacant for preventing the formation of the breaking wall into a thorn which penetrates the main charge and which when filled with water will permit the shockwave to penetrate and break the breaking wall into a thorn which penetrates the main charge and sets it off.

A further object of the invention is to provide a method of regulating the explosion of a main explosive charge which is positioned in alignment with a breaking wall and an actuating charge which when ignited is positioned to deform the breaking wall and deform it into a spike and hurl it into the main charge and which comprises providing a liquid fillable space between the igniting charge and the breakable wall so as to prevent the formation of a thorn by the breaking wall and filling the space with liquid when the main charge is to be set off so that upon detonating the actuating charge, a pressure wave is produced in the liquid fillable space by which the breaking wall is fragmented to form a piercing spike which penetrates into the main charge and sets if off.

A further object of the invention is to provide a safety fuze for setting off a main charge which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The only FIGURE of the drawing is a partial sectional view showing the orientation of a safety fuze in respect to a main explosive charge in a position in which the explosive device is situated in a liquid and which has been constructed in accordance with the invention.

DESCRIPTION OF THE PREFERRED EMBODIMENT

Referring to the drawing, in particular the invention embodied therein comprises a safety fuze having a safety fuze housing 1 which is positioned in alignment with a main explosive charge 10. The main explosive charge 10 advantageously includes a booster charge portion 11 and the main charge is set off by formation of a breaking wall 4 into a spike which travels in the direction of the arrow 14 which penetrates into the main charge to set if off.

The fuze comprises the housing 1 accommodating an initiating charge 2, a detonator 3, and the breaking wall 4. Detonator 3 and initiating charge 2 are received in a holding ring 5 which is secured to housing 1.

Breaking wall 4, designed in the present example as a conical lining of a hollow charge, and is secured to the housing 1 by its base rim. Instead of the conical wall, other conventional shapes of such linings may be provided.

A first intermediate space 6 is thus formed in housing 1 between initiating charge 2 and breaking wall 4. Space 6 may freely communicate with the ambience. To this end, apertures of perforations 7 are provided in housing 1. Instead, oblong slots might be provided or webs connecting the base rim of the breaking wall to that portion of housing 1 where the initiating charge is received.

In front of breaking wall 4, i.e. in the direction of the main explosive charge, a chamber 8 is formed in housing 1. This is a second intermediate space, also including the hollow of breaking wall 4. Chamber 8 is filled with air or another gas, or evacuated. Relative to the ambience, chamber 8 is hermetically sealed.

Initiating charge 2 comprises a secondary explosive, thus an explosive which is less sensitive than tetryl. A surface of the charge 2 facing breaking wall 4 is planar in the shown example. It may be of any shape, however, especially also complementary to breaking wall 4, thus, in the present design, of the shape of a hollow cone. Detonator 3 for the initiating charge 2 comprises a priming explosive, thus a explosive which is more sensitive than tetryl, and may be designed as an electrical device or with a striker. The initiating charge 2 may be watertightly sealed against the first intermediate space 6, or it may be made of a waterproof explosive. Holding ring 5 may be of a foamed plastic, such as polyurethane. Housing 1 is waterproof, for example of aluinum or an aluminum alloy, or of a plastic.

For breaking wall 4, a material usual for linings of shaped charges is employed, as far as impermeable to water, for example copper, aluminum, an aluminum alloy, or a plastic. The wall thickness of housing 1 is dimensioned to withstand a waterhead of up to 150 meters.

Fuze housing 1 is secured by a connection (not shown) to a jacket 9 of the main explosive charge 10. Further provided is the transmission and/booster charge 11, at the inside of jacket 9 and in line with the effective direction of the fuze, comprising an explosive which is more sensitive than the main explosive charge 10, but of course, less sensitive than the priming explosive of detonator 3.

Upon immersing the inventive fuze into water, the water 12 penetrates through apertures 7 in housing 1 into first intermediate space 6 and expels the air therefrom. Conversely, upon withdrawing the fuze from the water, the water flows out of first intermediate space 6 and air penetrates therein.

With water filling first intermediate space 6, the firing chain including detonator 3, initiating charge 2, water-filled space 6, and breaking wall 4 is closed. The water in space 6 transmits the shockwave produced by the ignited initiating charge 2, and causes the deformation of the breaking wall 4 into a piercing spike.

On the other hand, with water absent, and air present in space 6, the firing chain is interrupted. In other words, even with an ignition of initiating charge 2 due to an error, a detonation of main explosive charge 10 is prevented.

Advantageously, if breaking wall 4 is designed in the shape of a conical lining as in the shown example, the vertex of the cone still remains spaced from initiating charge 2, to prevent an air and vapor shockwave from an ignited charge 2 to fragment breaking wall 4 and thus form a piercing spike.

The distance of a front wall 13 of the chamber 8 from the breaking wall 4 is dimensioned to allow the wall 4 to form a piercing spike capable of igniting the transmission or booster charge 11 in jacket 9 and thus the main charge 10. This does not require the formation of a long spike since the depth of penetration is not critical.

A waterproof contact between the fuze or the front wall 13 of chamber 8 and jacket 9 is not required, since the performance of the formed spike remains practically unchanged even with an interposed water layer of some millimeters.

The inventive fuze operates as follows:

As soon as the fuze housing 1 which is secured to the jacket 9 of the main explosive charge 10 is immersed into water, first intermediate space 6 becomes filled with water 12 which flows therein through apertures 7 of housing 1. Upon igniting initiating charge 2 by means of detonator 3, a shockwave is produced in intermediate space 6 which is filled with water 12. This causes the deformation of the breaking wall 4 into a piercing spike.

The spike, which can be formed only in a chamber 8 filled with air or another gas, pierces the front wall 13 of chamber 8, penetrates a thin water layer which may extend between front wall 13 and the jacket 9, and impinges on the jacket 9 in the zone of transition or the booster charge 11 which is thereby ignited and sets off the main explosive charge 10. The spike forms only in the effective direction indicated by arrow 14, i.e. toward the main explosive charge 10.

After taking the fuze housing 1 out of the water, water 12 of space 6 flows out and is replaced by air, and even with an unintentional detonation of initiating charge 2, only an air or vapor pressure wave would be produced which is not capable of transforming wall 4 into a piercing spike, anyway not into a spike having a power to initiate transmission or booster charge 11.

Another precaution is taken, namely to prevent housing 1, after a detonation of initiating charge 2, from being fragmented into fast splinters which might act as the spike does. This may be done by selecting a proper material of holding ring 5 and of housing 1. Such materials have been mentioned above.

The principal advantage of the inventive fuze thus is that the transmission or booster charge 11 and thereby the main explosive charge 10 can be set off only as long as the fuze is immersed in water, and that the fuze is unprimed as soon as it is taken out of the water. Another advantage is that the housing 1 need not be in direct contact with the jacket 9 of main explosive charge 10 since a certain allowance is given in this regard.

The filling of intermediate space 6 with water 12 is a safety criterion which is independent of other safety conditions. Another independent safety condition may be obtained, for example, by making housing 1 pivotable on jacket 9. Then, by means of a mechanism 20, 21 on a support 22, in which is driven clockwork for example, housing 1 may be pivoted from the safety position in which the effective direction 14 of a formed spike would point away from the main explosive charge, into an armed position in which a formed spike acts in the direction of the transmission or booster charge 11.

While a specific embodiment of the invention has been shown and described in detail to illustrate the application of the principles of the invention, it will be understood that the invention may be embodied otherwise without departing from such principles.

What is claimed is:

1. A fuze for setting off jacketed explosive charges, comprising a breaking wall aimed at the explosive charge to be detonated, an initiating charge in alignment with said breaking wall, and a housing which encloses said initiating charge and said breaking wall and which can be brought into the vicinity of the jacket of the explosive charge, said fuze having a safety position which includes an empty space in said housing between said initiating charge and said breaking wall which is capable of being filled with a liquid to place the fuze in an off safety position, said empty spaced in said housing includes a perforated boundary wall to the exterior of said housing permitting the inflow and outflow of liquid thereto, said jacketed explosive charge comprises an underwater explosive charge, said perforated boundary communicating with the ambience, said housing having a chamber between said breaking wall and the end of said housing adjacent the explosive charge, said chamber being gas filled and permitting a free formation of said breaking wall into a piercing fragment adapted to penetrate the main explosive charge, said breaking wall being spaced apart from said initiating charge and being a cone shaped liner for forming said piercing fragment, said initiating charge being of type to form said cone shaped liner into said piercing fragment.

2. A fuze according to claim 1, including means mounting said housing for pivotal movement on the explosive charge.

3. A fuze according to claim 1, wherein the main charge includes a booster charge aligned with the breaking wall.

4. A safety fuze for setting off a main charge comprising a housing having a front end positionable towards the main charge, an initiating charge in said housing, a break wall in said housing positioned adjacent said initiating charge in alignment with the main charge and capable of being deformed to a spike which penetrates the main charge upon setting off of the initiating charge in said housing, an empty space in said housing between said initiating charge and said break wall and providing a safety space preventing deformation of the break wall upon a setting off of the initiating charge, said empty space being bounded by a wall of said housing having an opening permitting the space to be filled with liquid, said housing having an empty chamber between said break wall and the main charge, including a main charge havivg a booster charge portion aligned with said breaking wall, said initiating charge wearing a shock absorbing material therearound positioned away from said break wall.

5. A method of regulating the explosion of a main explosive charge which is positioned in alignment with a breaking wall and an initiating charge which when ignited is located so as to deform the breaking wall into a spike and hurl it into the main charge to set off the main charge, comprising providing a liquid fillable space between the initiating charge and the breaking wall of a size to prevent the formation of a shock wave to deform the breaking wall when the main charge is not to be exploded, and filling the space with liquid when the main charge is to be set off so that upon detonation of the initiating charge a shockwave is produced in the liquid of the liquid fillable space by which the breaking wall is fragmented to form a piercing spike which penetrates into the main charge and sets if off, and wherein the used housing is thrown into the water so as to fill the housing with the water when the charge is to be in an off safe position.

* * * * *